US009415258B1

(12) United States Patent
Higgins et al.

(10) Patent No.: US 9,415,258 B1
(45) Date of Patent: Aug. 16, 2016

(54) MODULAR SYSTEM FOR EXERCISE AND MUSCLE MANIPULATION WORK

(71) Applicant: Cygnet Systems LLC, Carrollton, TX (US)

(72) Inventors: Stephen Mark Higgins, Carrollton, TX (US); Constance Ann Swanston, Carrollton, TX (US)

(73) Assignee: Cygnet Systems LLC, Carrollton, TX (US)

( * ) Notice: Subject to any disclaimer, the term of this patent is extended or adjusted under 35 U.S.C. 154(b) by 0 days.

(21) Appl. No.: 14/937,859

(22) Filed: Nov. 10, 2015

(51) Int. Cl.
*A63B 21/22* (2006.01)
*A63B 21/00* (2006.01)

(52) U.S. Cl.
CPC ..... *A63B 21/22* (2013.01); *A63B 21/0004* (2013.01)

(58) Field of Classification Search
CPC ..... A63B 21/0004; A63B 21/22; A63B 22/20–22/203; Y10T 403/55–403/5733
See application file for complete search history.

(56) References Cited

U.S. PATENT DOCUMENTS

| | | | | |
|---|---|---|---|---|
| 6,974,427 | B1 * | 12/2005 | Lapham | A61H 15/00 601/120 |
| 2004/0024336 | A1 * | 2/2004 | Lin | A61H 5/0092 601/107 |
| 2006/0084894 | A1 * | 4/2006 | Anderson | A61H 7/006 601/118 |
| 2012/0065557 | A1 | 3/2012 | Phillips | |
| 2015/0245977 | A1 * | 9/2015 | Sungarian et al. | A61H 15/00 601/118 |
| 2016/0030797 | A1 * | 2/2016 | Erickson | A63B 21/22 482/132 |

* cited by examiner

*Primary Examiner* — Oren Ginsberg
*Assistant Examiner* — Jennifer M Deichl
(74) *Attorney, Agent, or Firm* — R. Johnston Law, PLLC

(57) ABSTRACT

In one instance, a modular system for exercise and muscle manipulation work is presented that allows a user to easily carry numerous components and then quickly assemble or separate the components to facilitate a variety of exercises and muscle manipulation work. The components are quickly assembled or separated using rotatable and releasable magnetic quick-link couplers. Other systems and methods are included.

23 Claims, 8 Drawing Sheets

MODULAR SYSTEM FOR EXERCISE AND MUSCLE MANIPULATION WORK

TECHNICAL FIELD

This application is directed, in general, to exercise equipment and muscle relief devices, and more specifically, to methods and systems for exercise and muscle manipulation work.

BACKGROUND

Today many people recognize the value of exercise and various types of muscle manipulation work to help promote a healthy body. Exercise promotes, among other things, cardiovascular health, strength, and endurance. Muscle manipulation work includes, without limitation, massages, roller work, trigger point work, and the like for muscles, tendons, and connective tissue. Trigger points (also known as muscle knots) are sensitive spots that are typically the result of injuries or overactive use. Muscle manipulation work can help relax and loosen muscles and promote rehabilitation.

SUMMARY

According to an aspect of the disclosure, a system is presented that allows various components to be quickly assembled or separated to use for exercises or muscle manipulation work. A plurality of quick magnetic couplers is used to allow the components to be assembled and separated. The exterior of at least some of the components are covered with foam to be used as adhesion rollers. Rotation of the couplers allows the components in certain configurations to be used as exercising devices.

According to one illustrative embodiment, the system provides a reselectable combination of modules or components, to be configured by the user for specific targeted function, to accomplish the diminishment of myofascial muscle adhesion phenomenon, as well as the release of muscle tissue contraction or other purposes, as well as being, in a group of configurations, an active applied exercise mechanism, used to target specific myofascial adhesion issues, specific muscle contraction issues and specific muscle groups. The modular system includes mechanisms, that when combined into differing configurations, present differing mechanical features to accomplish specific tasks based on each configuration.

According to one illustrative embodiment, a modular system for exercise and muscle manipulation work includes a central member having a cylindrically-shaped body and a first end and a second end; a first attachment member having a first end and a second end; and a second attachment member having a first end and a second end. The system also includes a first rotatable and releasable magnetic quick-link coupler associated with the central member and the first attachment member for releasably and rotatably coupling the central member to the first attachment member and a second rotatable and releasable magnetic quick-link coupler associated with the central member and the second attachment member for releasably and rotatably coupling the central member to the second attachment member. Each of the rotatable and releasable magnetic quick-link couplers includes a protruding member having a first magnetic member, a female receptacle sized and configured to receive at least a portion of the protruding member and having a second magnetic member. The first magnetic member and second magnetic member include at least a magnet and a complimentary attractive material. The complimentary attractive material is a second magnet or a magnetically-attractive material. The central member may be for example, without limitation, a first roller member. The first attachment member may be an adhesion release ball, a handle tool, a roller member, a trigger point tool, or another tool.

According to another illustrative embodiment, a modular system for exercise and muscle manipulation work includes a first roller member having a cylindrically-shaped body and a first end and a second end. The first roller member has a diameter that is greater than four inches and less than 18 inches. The first roller member comprises a plurality of adhesion roller disc members formed from a polymer-based foam and disposed over a first tubular member, each of the plurality of adhesion roller disc members formed with a plurality of longitudinal grooves. The longitudinal grooves are substantially parallel to a longitudinal axis of the first roller member. The modular system further includes a first attachment member having a first end and a second end and a first rotatable and releasable magnetic quick-link coupler rotatably and releasably coupling the first end of the first roller member and the second end of the first attachment member. The first rotatable and releasable magnetic quick-link coupler comprises at least one magnet and at least two mating members. The system also includes a second attachment member having a first end and a second end and a second rotatable and releasable magnetic quick-link coupler rotatably and releasably coupling the second end of the first roller member and the first end of the second attachment member, wherein the second rotatable and releasable magnetic quick-link coupler comprises at least one magnet and at least two mating members.

According to another illustrative embodiment, a method of manufacturing a modular system for exercise and muscle manipulation work includes providing a first longitudinal tubular member; disposing a plurality of adhesion roller disc members about the longitudinal tubular member to form a first roller member having a first end and a second end and having a diameter greater than four inches; providing a first attachment member formed with a second longitudinal tubular member and having a first end and a second end; and providing a first rotatable and releasable magnetic quick-link coupler having a first member and a second member. The method also includes coupling the first member of the first rotatable and releasable magnetic quick-link coupler to the second end of the first attachment member; coupling the second member of the first rotatable and releasable magnetic quick-link coupler to the first end of the first roller member; providing a second attachment member formed with a third longitudinal tubular member having a first end and a second end; providing a second rotatable and releasable magnetic quick-link coupler having a first member and a second member; coupling the first member of the second rotatable and releasable magnetic quick-link coupler to the second end of the first roller member and first end of the second attachment member; and coupling the second member of the second rotatable and releasable magnetic quick-link coupler to the first end of the second attachment member. Other systems and methods are presented herein.

DESCRIPTION OF THE DRAWINGS

Illustrative embodiments of the present invention are described in detail below with reference to the attached drawing figures, which are incorporated by reference herein and wherein.

DETAILED DESCRIPTION

Figure 1:
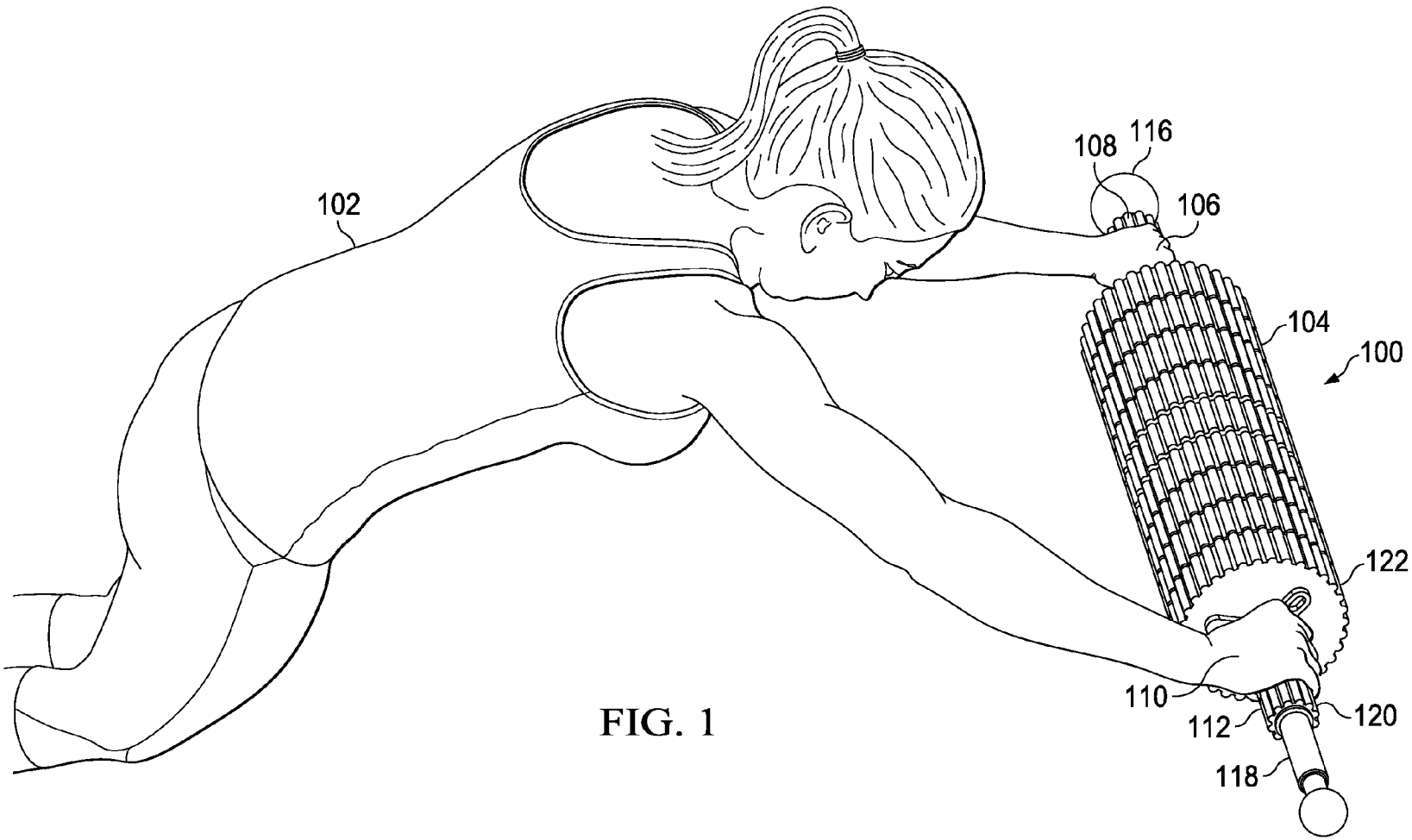
FIG. 1 is a schematic, perspective view of a person using an illustrative embodiment of a modular system for exercise and muscle manipulation work shown in one configuration.

In the following detailed description of the preferred embodiments, reference is made to the accompanying drawings that form a part hereof, and in which is shown, by way of illustration, specific embodiments in which the invention may be practiced. These embodiments are described in sufficient detail to enable those skilled in the art to practice the invention, and it is understood that other embodiments may be utilized and that logical structural, mechanical, electrical, and chemical changes may be made without departing from the spirit or scope of the invention. To avoid detail not necessary to enable those skilled in the art to practice the invention, the description may omit certain information known to those skilled in the art. The following detailed description is, therefore, not to be taken in a limiting sense, and the scope of the present invention is defined only by the claims. Unless otherwise indicated, as used throughout this document, "or" does not require mutual exclusivity.

The disclosure presents systems and devices that allow a person, or user, to use a single modular system to quickly accomplish different exercises and muscle manipulation work. Various possible components of the system may be interchanged using a plurality of rotatable and releasable quick-link couplers. The rotatable and releasable quick-link couplers allow the components to be held together, released when a releasing force is applied beyond a threshold, and when assembled to provide for relative motion between the components. The various possible configurations of the system and the relative movement between modules are useful. For example, a personal trainer could carry one system to a client's locale and yet provide many different exercises or avenues for muscle manipulation work with that one system.

The exterior of at least some of the components are covered with foam to be used as adhesion rollers. An adhesion roller, or roller, is typically a device designed to provide muscle manipulation by the transfer of force created by body weight. The force is distributed from the body to the surface of the adhesion roller and to the foundation surface (e.g., floor, block, table, etc.). The adhesion roller may be used as a static device with the load path from the body to the roller to the stable foundation surface or as a dynamic device in that the rolling action of a cylindrical section of the roller relative to both the foundation surface and the body creates a moving load path between the body, adhesion roller, and the foundation surface to cover more area range as demanded by the required muscle manipulation. Other uses may be made of the adhesion roller as well for the purpose of manipulating muscles.

In one illustrative embodiment, the disclosure includes a product for the fitness industry that involves a selectable combination of modules, to be configured by the user for specific targeted function to address myofascial muscle adhesion phenomenon, as well as the release of muscle tissue contraction, as well as being, in a group of configurations, an active applied exercise mechanism used to target specific muscle groups. The modular system includes mechanisms, that when combined into differing configurations, present differing mechanical features to accomplish specific tasks based on each reconfiguration.

Referring now to the FIGURES, and initially to FIG. 1, a modular system for exercise and muscle manipulation work 100 is shown in use. The modular system for exercise and muscle manipulation work 100 is shown being used by a participant 102, or user, as an abdominal exercise roller 104. The modular system for exercise and muscle manipulation work 100 may be used for various exercises or for muscle manipulation work on the participant 102 as will explained further below.

The participant's left hand 106 is shown grasping a first handle tool 108, and the participant's right hand 110 is shown grasping a second handle tool 112. The abdominal exercise roller 104, which may be made up of one or more rollers, e.g., first roller member 122, is rotatably and releasably coupled to the first handle tool 108 by a first rotatable and releasable magnetic quick-link coupler (described further below) and to the second handle tool 112 by a second rotatable and releasable magnetic quick-link coupler (described further below). The rotatable and releasable magnetic quick-link couplers allow rotation like a bearing so the participant 102 may hold the handle tools 108, 112 in place while the roller member 122 rotates relative to the handle tools 108, 112. At the same time, an axial, separating force beyond a separating threshold may cause the rotatable and releasable magnetic quick-link couplers to release from the roller member 122.

The modular system for exercise and muscle manipulation work 100 may include numerous other components and couplers as will be apparent to those skilled in the art after reading the disclosure herein. The modular system for exercise and muscle manipulation work 100 is shown with an adhesion release ball 116, or ball, rotatably and releasably coupled to a first end (not explicitly shown) of the first handle tool 108, and the system 100 includes a trigger point tool 118 rotatably and releasably coupled to a second end 120 of the second handle tool 112.

Figure 2:
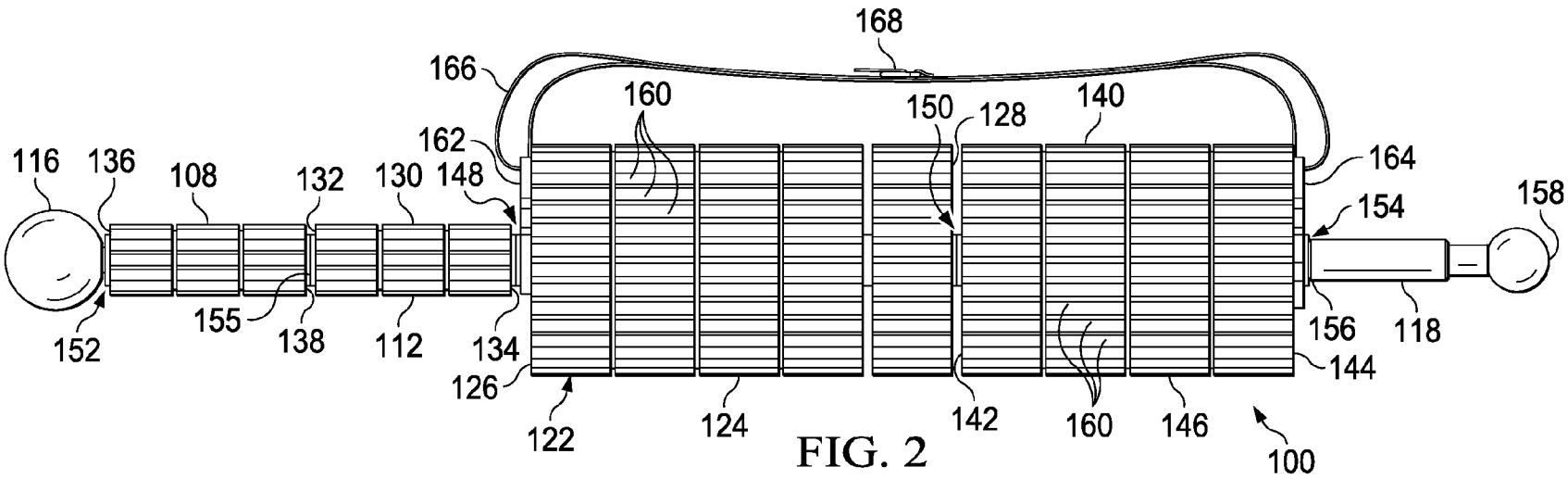
FIG. 2 is a schematic, elevation view of the modular system for exercise and muscle manipulation work of FIG. 1.

Referring now primarily to FIG. 2, the illustrative embodiment of the modular system 100 for exercise and muscle manipulation work is shown in a different configuration. This illustrative embodiment of the modular system 100 for exercise and muscle manipulation work in this instance includes a central member, which in this embodiment is a first roller member 122, having a cylindrically-shaped body 124 and a first end 126 and a second end 128. The system 100 also includes a first attachment member 130 having a first end 132 and a second end 134. In this instance the first attachment member 130 is a second handle tool 112. The first handle tool 108 having a first end 136 and a second end 138 may be coupled at the second end 138 to the first end 132 of the second handle tool 112. The system 100 also includes a second attachment member 140 having a first end 142 and a second end 144. In this example the second attachment member 140 comprises a second roller member 146.

The modular system 100 for exercise and muscle manipulation work also includes a first rotatable and releasable magnetic quick-link coupler 148 associated with the central member, e.g., first roller member 122, and the first attachment member 130 for releasably and rotatably coupling the first roller member 122 to the first attachment member 130. The system 100 also includes a second rotatable and releasable magnetic quick-link coupler 150 associated with the central member, e.g., first roller member 122, and the second attachment member 140 for releasably and rotatably coupling the first roller member 122 to the second attachment member 140.

The modular system 100 for exercise and muscle manipulation work may also include the adhesion release ball 116, or ball, that is coupled to the first end 136 of the first handle tool 108 by a third rotatable and releasable magnetic quick-link coupler 152. The system 100 may further include the trigger point tool 118 that is coupled to the second end 144 of the second attachment member 140 by a fourth rotatable and releasable magnetic quick-link coupler 154. The trigger point tool 118 has a first end 156 and a second end 158. The two handle tools 108, 112 are coupled by a fifth rotatable and releasable magnetic quick-link coupler 155. A longitudinal axis (not explicitly shown) runs from the adhesion release ball 116 to the second end 158 of the trigger point tool 118.

In this illustrative embodiment, each of the first handle tool 108, second handle tool 112, first roller member 122, and second roller member 146 have an exterior surface formed from a flexible material, such as a relatively stiff polymer foam, e.g., 4 lb./ft$^3$ to 9 lb./ft$^3$. Examples of suitable foam may include mono-cellular cross link polyethylene foam or closed-cell foam. Moreover, in this embodiment, a plurality of optional longitudinal grooves 160 is formed on the exterior of the surface of the flexible material. The plurality of longitudinal grooves 160 may be formed using any of number techniques, e.g., water jet, laser, mechanical cutting, for removing a portion of the flexible material to form the grooves 160. The grooves 160 may be spaced radially and equally or with a pattern about the longitudinal axis. The longitudinal grooves 160 may be formed substantially parallel to the longitudinal axis (e.g., 170 in FIG. 3).

The modular system 100 for exercise and muscle manipulation work may include a first strap holder 162 coupled to the first end 126 of the first roller member 122 and a second strap holder 164 coupled to the second end 144 of the second attachment member 140. A strap 166 may be coupled to the first strap holder 162 and the second strap holder 164. One embodiment of the strap holders 162, 162 is presented further below in FIG. 5. The strap 166 may form a loop going through each of the strap holders 162, 164 and having an adjustment or release buckle 168. The strap 166 may be applied for convenience of carrying the system 100 and then may be removed during use. It should be appreciated that the strap 166 and strap holders 162, 164 are optional. In another embodiment, a carrying case or bag sized and configured to fit over a full embodiment of the system 100 may be used and may have a strap for carrying the system 100.

Figure 3:
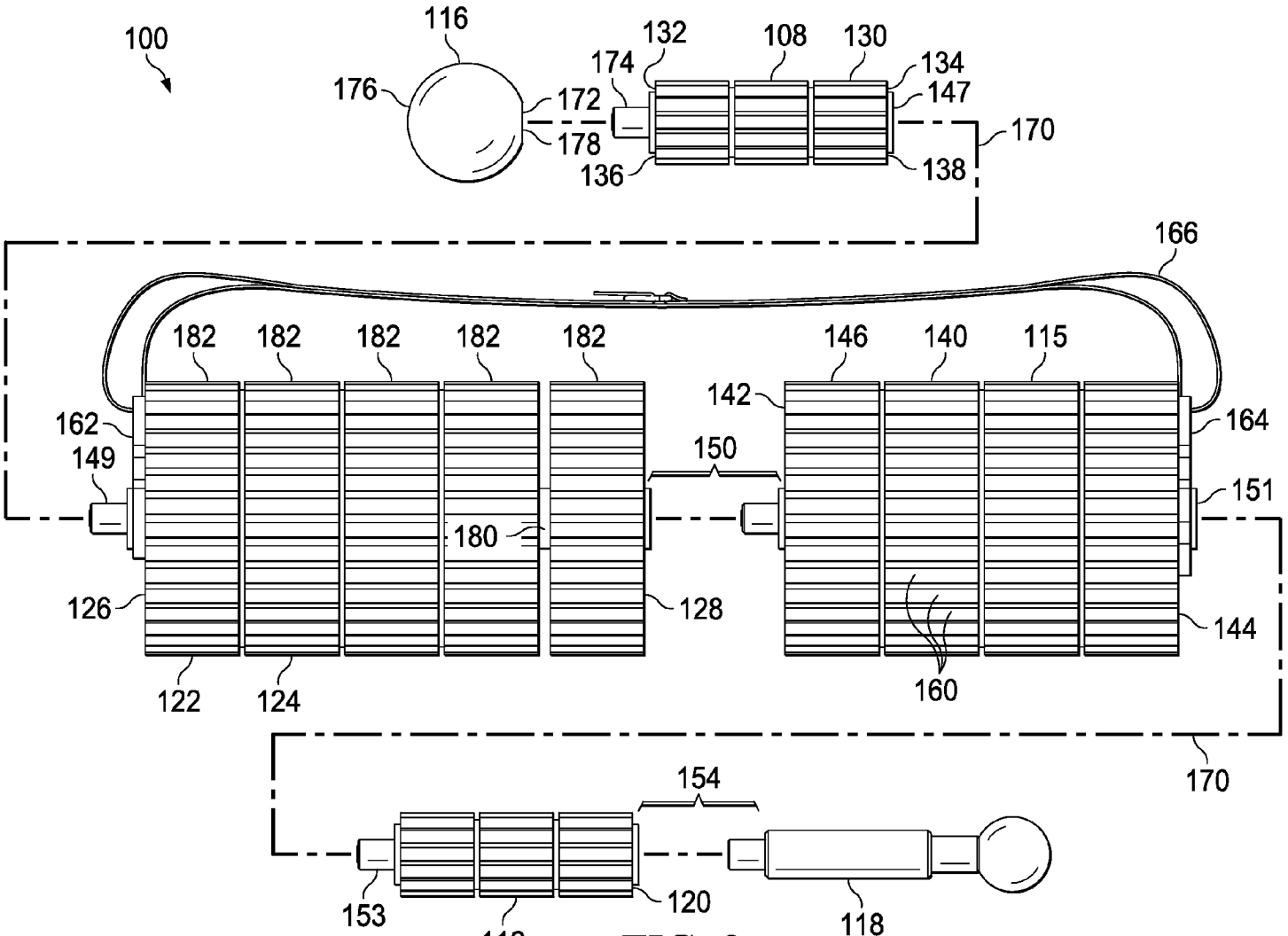
FIG. 3 is a schematic, exploded, elevation view of an illustrative embodiment of a modular system for exercise and muscle manipulation work.

Referring now primarily to FIG. 3, another illustrative embodiment of the modular system 100 for exercise and muscle manipulation work is presented with a different configuration and in an exploded view. While presented as serpentine for space reasons in the figure, the system 100 has a longitudinal axis 170 that in the assembled position would obviously be straight. The components remain the same in this embodiment as compared to FIG. 2, but the second handle tool 112 is now on the other side. The parts numbers remain the same.

In this view, the first rotatable and releasable magnetic quick-link coupler 148 is seen to comprise a first member 147 and a second member 149. In this instance, the first member 147 is a female receptacle member, and the second member 149 is a protruding member, but they could be reversed. The members 147, 149 are sized and configured to mate and remain magnetically attracted when in an assembled position as will be explained in connection with FIG. 4 below. The other rotatable and releasable magnetic quick-link couplers are analogous. The second rotatable and releasable magnetic quick-link coupler 150 couples the central member, e.g., roller member 122, and the second attachment member 140. The third rotatable and releasable magnetic quick-link coupler is formed with a first member 151, which in this instance is a female receptacle member, and a second member 153, which in this case is a protruding member.

The adhesion release ball 116, or adhesion ball, is coupled with another rotatable and releasable magnetic quick-link coupler to the first handle tool 108. The rotatable and releasable magnetic quick-link coupler for this coupling is formed with a first member 172 in the adhesion release ball 116 and a second member 174 on the first end 132 of the first handle tool 108. The adhesion release ball 116 has a first end 176 and a second end 178. The first member 172 is a female receptacle member formed in the adhesion release ball 116 at the second end 178.

In many embodiments, the handle tools 108, 112, first roller member 122, and second roller member 115 are formed in a similar manner. In each instance an analogous construction may be used. For illustrations purposes, consider the first roller member 122 as shown in FIG. 3. A tube member 180 is supplied. The tube may be formed from aluminum, steel, titanium, hard plastic, or any rigid material. In one illustrative, non-limiting embodiment, a 6061 alloy t6 aluminum tube of about 0.75 inches (1.9 cm) diameter (outside) and a 0.065 inch (1.65 cm) wall thickness was used, but a person of skill in the art will appreciate that a wide variety of materials and sizes may be used. In other embodiments, different techniques may be used on each.

A plurality of flexible discs, e.g., adhesion roller disc members 182, are made from a flexible material, e.g., a foam material, and then added to the tube member 180. The tubular member 180 extends through a center portion of each of the adhesion roller disc members 182. In some embodiments, the roller disc members 182 may not be attached but may be free to rotate. In other embodiments, the roller disc members 182 may be attached to the tube member 180 using glue, bonding, fastener, interference fit, or other technique. The size of the roller disc members 182 may vary with different parts. For example, the first roller member 122 and second roller member 146 may have an outside diameter between 4 and 18 inches (10.6-45.7 cm) or other dimension, and often each is about 5 inches (12.7 cm). The outside diameter of the first and second handle tools 108, 112 may be in the range of 1.5 to 3 inches (3.8-7.62 cm). The adhesion release ball 116 may have a diameter between 1 and 5 inches (2.54-12.7 cm).

As previously noted, the exterior of the roller disc members 182 may have longitudinal grooves 160 formed. In an illustrative embodiment, at least one of the roller disc members 182 may be less rigid than an average stiffness for the plurality of adhesion roller disc members. This may be desirable for when the system 100 is being used as an adhesion roller and used on a back or shin or other sensitive body part; in such cases, it may be desirable to have a softer portion for the sensitive body part. In other embodiments, lateral grooves may be formed in lieu or in addition to the longitudinal grooves. In still other embodiments, various shapes may be formed on the foam, or deep, light, medium, and harder may foams may be used and the surface design may be adjusted to impact the angular contact and pressures when used as an adhesion roller.

Figure 4:
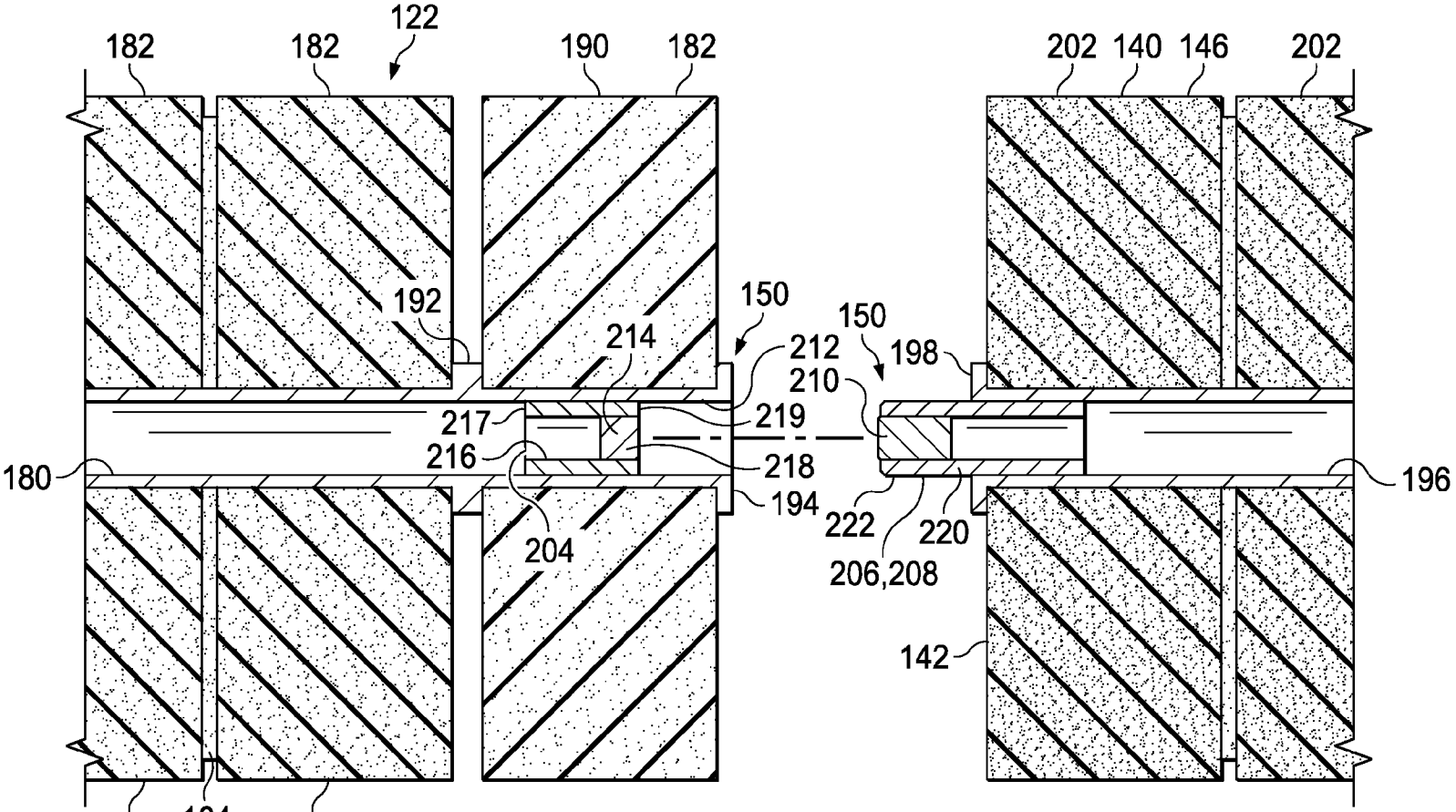
FIG. 4 is a schematic, elevational cross section of a portion of the modular system for exercise and muscle manipulation work of FIG. 3 showing one illustrative embodiment of a rotatable and releasable quick-link coupler.

Referring now primarily to FIG. 4, for illustration purposes a detail of the rotatable and releasable magnetic quick-link coupler 150 and a portion of the first roller member 122 and second attachment member 140, which is another roller member in this embodiment, are shown in a cross section. The rotatable and releasable magnetic quick-link coupler 150 is in a separated position.

With reference to the first roller member 122, the tube member 180 may be seen more clearly along with the plurality of disc members 182. In this view an optional spacer member 184 may be seen between adjacent members of the plurality of disc members 182. Optional spacer members 182 may be disposed between one or more adjacent members of the plurality of disc members 182 for aesthetics or, in embodiments with the disc members not adhered to the tubular member 180, to facilitate rotation of the disc members 182. In one embodiment, the disc members 182 are a first color and a plurality of spacer members 184 are of a different color.

As previously suggested, each of the plurality of disc members 182 may be the same and formed from a flexible material, but in other embodiments, one or more discs of the plurality of disc members 182 may have differing stiffnesses or densities. For example, in FIG. 4, a first disc member 186 and a second disc member 188 may be formed of a first stiffness and a third disc member 190 may be less stiff or less rigid. The third disc member 190, or less rigid disc member 190, may be strategically placed to allow the third disc member 190 to be placed against a sensitive body part, e.g., spine or shin, while allowing the more rigid disc members 186, 188 to contact muscles for muscle manipulation work. The less rigid disc member 190 may be held in place by a positioning ring 192. The positioning ring 192 may be a spacer that has been attached to the tubular member 180 or a ridge formed as part of the tubular member 180. In other embodiment, the positioning ring 192 may be omitted.

In some embodiments, the third disc member 190 may be at least 10 percent less rigid than an average stiffness for the plurality of adhesion roller disc members 182. The rigidity or stiffness may be measured by any known means. In one approach, an item may be pressed against the exterior of each adhesion roller disc members while noting the distance of inward compression. The distances when compressed may be then be compared for each disc member. Many other approaches to measuring the rigidity or softness of the material are possible. In some embodiments, multiple members of the plurality of disc members may be softer or harder than the average for different impacts.

A second end 194 of the tubular member 180 is shown with a flange 194 that holds the plurality of disc members 182 on the tubular member 180 particularly in embodiments where the plurality of disc members 182 are free to rotate. The flange 194 may be attached to the tubular member 180 by interference fit, welded, bonded, or attached with any other technique or formed integrally.

The second attachment member 140, which in this embodiment is a second roller member 146, is formed in an analogous fashion. Thus, the second roller member 146 also has a tubular member 196, a flange 198 proximate the first end 142, and a plurality of disc members 202.

The rotatable and releasable magnetic quick-link coupler 150 is formed with a first member 204 and a second member 206. In this example, the second member 206 is a protruding member 208 having a first magnetic member 210. The second member 204 is a female receptacle member 212 sized and configured to receive at least a portion (and typically all) of the protruding member 208. The female receptacle member 212 includes a second magnetic member 214. The first magnetic member 210 and the second magnetic member 214 may both be magnets with polarity such that they attract each other or one may be a magnet and the other may be a magnetically attractive material such as a metal mass. In short the second magnetic member 214 is a complimentary attractive material—either magnet or attractive metal or other attractive material. In any event, at least one of the first magnetic member 210 and second magnetic member 214 comprises a magnet. The magnets used may be rare earth magnets, e.g., high flux density (c45) or earth magnet. In one illustrative, non-limiting, example a Neodymium-Iron-Boron magnet with 23 pounds attractive force was used.

The first magnetic member 204 is shown with a tubular member 216 sized and configured to fit within the first tubular member 180—the clearance may be 0.002 inches (0.0508 mm) or more. The tubular member 216 has a first end 217 and a second end 219. The internal tubular member 216 has an outside diameter that is approximately the same as the inside diameter of the first tubular member 180. The tubular member 216 may be secured within the first tubular member 180 by interference fit, glue, bonding, or any other technique. In this embodiment, a magnet 218 is secured within the tubular member 216 by glue, bonding, interference fit, or any technique. The magnet 218 is flush with the second end 219 of the internal tubular member 216. The second end 219 is displaced from the flange 194 a distance substantially equal to or greater than that of the protruding member 208. In still another embodiment, the second member 204 maybe formed as one single magnet with out requiring tubular member 216.

To form the second member 206, another internal tubular member 220 is introduced into the tubular member 196 to be positioned proximate a flange 198. The tubular member 220 has an outside diameter that is approximately the same as the inside diameter of the tubular member 196. The tubular member 220 may be secured in position by interference fit, glue, bonding, or any technique. In securing the tubular member 220 in the tubular member 196, a protruding portion 222 extends beyond the flange 198 and is sized to be approximately the same length or shorter than the depth with which the second end 219 of the tubular member 216 was displaced from the flange 194. The protruding portion 222 is sized to have a smaller outer diameter than the inner diameter of the tubular member 180 in order to allow rotation to readily occur between the two when in the assembled position.

In going from the separate position shown in FIG. 4 to the assembled position (e.g., as in FIG. 2), the protruding portion 222 is inserted into the tubular member 180 proximate flange 194 and the first member 204 and second member 206 are brought towards each other such that a magnetic field causes the two members 204, 206 to attract each other remain in proximity. This forms the assembled position. When ready to go to the separated position, a user pulls the first member 204 and second member 206 away from each (away axially along the longitudinal axis) with a force that will cause the two members 204, 206 to separate once a separation threshold force has been meet. This procedure (going to the assembled position and separated position) may be accomplished by a user very quickly. In one example, it takes less than two seconds to assemble or disassemble.

All the rotatable and releasable magnetic quick-link couplers are analogous to the rotatable and releasable magnetic quick-link coupler 150 that has been described. These rotatable and releasable magnetic quick-link couplers allow for not only quick connection and release of components in the system 100 so as to assume a wide variety of configurations, but are configured to allow rotation between components. Because the protruding portion 222 is sized and configured to rotate in the tubular member 180, rotation between components may be achieved allowing for additional versatility. It should be noted that other embodiments of the rotatable and releasable magnetic quick-link couplers may be used and in each instance they will have at least one magnet to facilitate a quick release.

Figure 5:
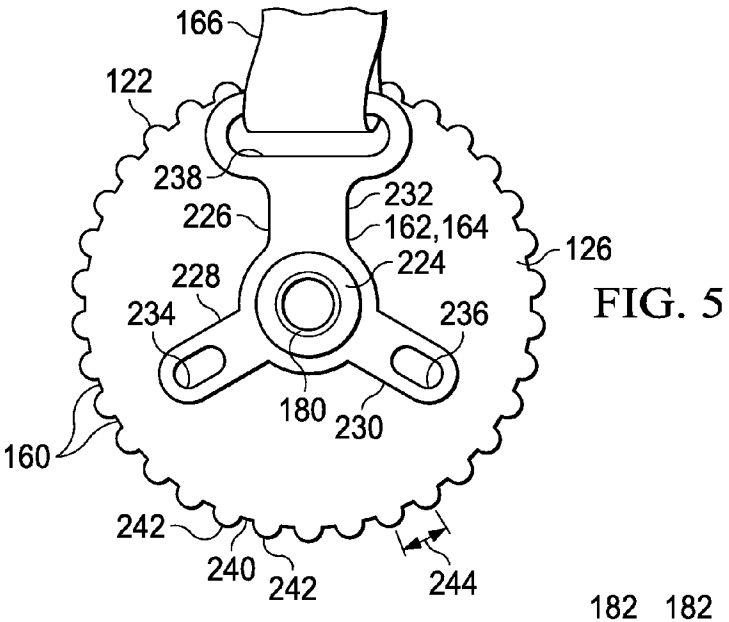
FIG. 5 is a schematic, side elevation view of a portion of an illustrative embodiment of a modular system for exercise and muscle manipulation work.

Referring now to FIG. 5, an end view of a roller member, e.g., the first end 126 of the roller member 122, is shown. The first strap holder 162 has a portion that is under a flange 224 that is attached to tubular member 180. The first strap holder 162 has a body 226 formed with three wings 228, 230, 232, which in this embodiment are spaced at approximately 120 degree intervals, but numerous options are possible. Wings 228 and 230 have openings 234 and 236, which serve as opening to attach accessories. Wing 232 has a strap loop 238 for receiving the strap 166. It should be understood that numerous variations are possible, but this provides a way to secure the strap 166. With two strap holders 162, 164 displaced from one another along the longitudinal axis of a configured system with all the components, the strap 166 may be applied and the system 100 carried with the strap 166.

In this view, one can clearly see the plurality of grooves 160. Each groove has a trough 240 and adjacent ridges 242. The pitch 244 is the linear distance between adjacent ridges or troughs. The depth from the ridges 242 to the bottom of the trough 240 may be in the range of 1/16 inch to 1/2 of an inch (15.8 mm to 1.27 cm). The radius of the grooves may be in the range of 1/16 of an inch to a half an inch (15.8 mm to 1.27 cm). The pitch is linear dimension to like locations on adjacent tooth components, e.g., 1/2 inch pitch is 1/2 inch between centers of adjacent trough features. In illustrative, non-limiting example, for a diameter less than three inches, a 3/8 inch pitch is used and for a diameter greater than three inches, a 1/2 inch pitch is used.

Figure 6A:
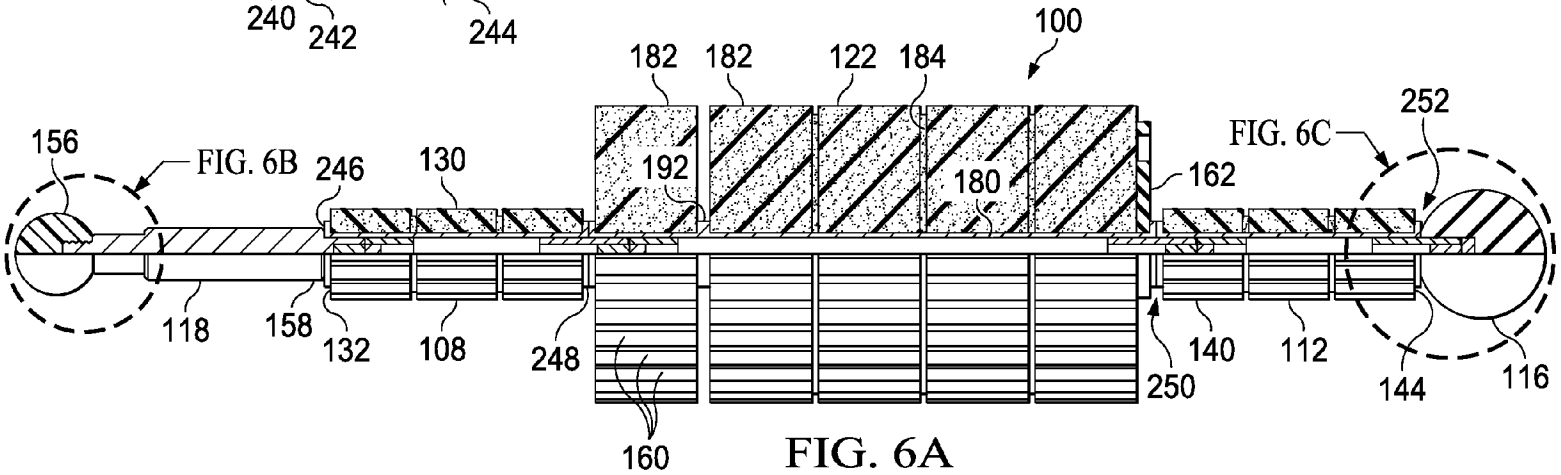
FIG. 6A is a schematic, elevation view with a portion in cross section of an illustrative embodiment of a modular system for exercise and muscle manipulation work shown in another configuration.

Referring now primarily to FIG. 6A, another configuration of the modular system 100 for exercise and muscle manipulation work is presented with a portion shown in cross section. In this embodiment, there is the central member, which in this embodiment is the first roller member 122, coupled at one end to a first attachment member 130, which is the first handle tool 108, and coupled at the other end to a second attachment member 140, which is the second handle tool 112. The trigger point tool 118 is coupled to the first end 132 of the first handle tool 108. The adhesion release ball 116 is coupled to the second end 144 of the second handle tool 112. The trigger point tool 118 is coupled to the first handle tool 108 by a rotatable and releasable magnetic quick-link coupler 246. The first handle tool 108 is coupled to the first roller member 122 by another rotatable and releasable magnetic quick-link coupler 248. The first roller member 122 is coupled to the second handle tool 112 by another rotatable and releasable magnetic quick-link coupler 250. Finally, the second handle tool 112 is also coupled to the adhesion release ball 116 by another rotatable and releasable magnetic quick-link coupler 252. Each of the rotatable and releasable magnetic quick-link couplers is analogous to the one presented in connection with FIG. 4.

Figure 6C:
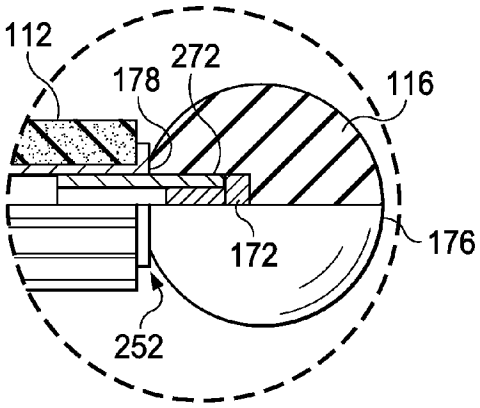
FIG. 6C is a detail of one end of the modular system for exercise and muscle manipulation work of FIG. 6A.
Figure 6B:
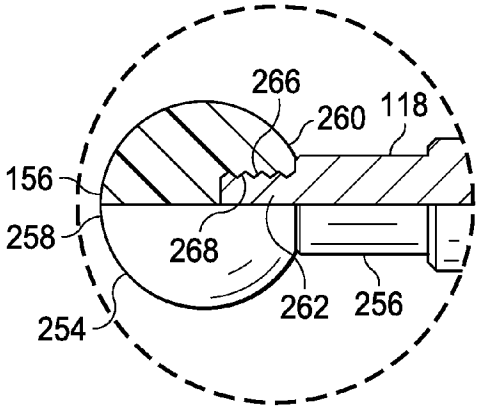
FIG. 6B is a detail of one end of the modular system for exercise and muscle manipulation work of FIG. 6A.
Figure 8:
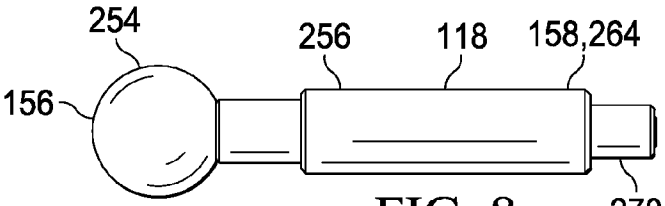
FIG. 8 is a schematic, elevation view of an illustrative embodiment of a portion of a modular system for exercise and muscle manipulation work showing a trigger point tool.

Referring now primarily to FIGS. 6B and 8, additional aspects of one illustrative embodiment of the trigger point tool 118 are presented. The trigger point tool 118 may or may not be used as part of the previously presented systems 100. The trigger point tool 118 has the first end 156 and second end 158. The trigger point tool 118 includes a ball 254 at the first end 156 that is coupled to a longitudinal body 256. The ball 254 has a first end 258 and a second end 260. The longitudinal body 256 has a first end 262 and a second end 264. The second end 260 of the ball 254 may be formed with a threaded opening 266 sized and configured to receive a threaded male portion 268 formed on the first end 262. The threaded male portion 268 and threaded opening 266 facilitate coupling of the ball 254 to the longitudinal body 256. The second end 264 of the longitudinal body 256 is coupled to one member 270, which in this embodiment is a protruding member, of a rotatable and releasable magnetic quick-link coupler.

The trigger point tool 118 may be separated from other components and used alone. The trigger point tool 118 is used for working a particular muscle. A force may be applied axially (along the longitudinal axis) to force the ball 254 against the muscle or may be rolled so the longitudinal body 256 works the muscle.

Figure 14:
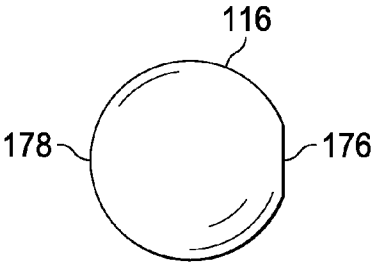
FIG. 14 is a schematic, elevation view of an illustrative embodiment of a portion of a modular system for exercise and muscle manipulation work showing an adhesion release ball.

Referring now to FIGS. 6C and 14, additional aspects of one illustrative embodiment of the adhesion release ball 116, or adhesion ball, are presented. Like the trigger point tool, the adhesion release ball 116 may be used while coupled other components or alone. The adhesion release ball 116 has the first end 176 and second end 178. Proximate the second end 178 a cylindrical opening is formed into which a portion of a rotatable and releasable magnetic quick-link coupler is disposed. In this embodiment, the first member 172 is disposed therein and is a female receptacle member. The complimentary protruding member 272 of the second handle 112 is shown in FIG. 6C mated with the female receptacle member. Uses for the adhesion release ball 116 are described further below.

Figure 7:
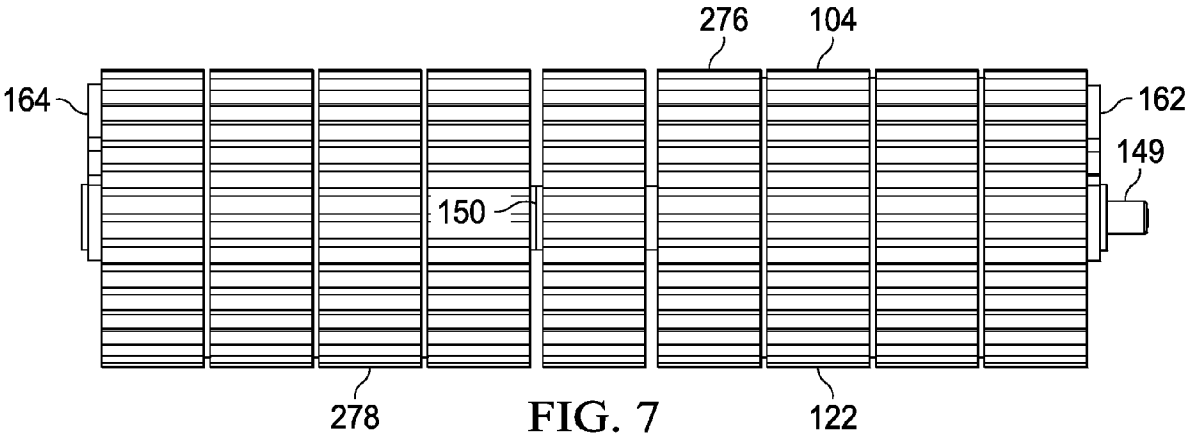
FIG. 7 is a schematic, elevation view of an illustrative embodiment of a modular system for exercise and muscle manipulation work in another configuration.

Referring now primarily to FIG. 7, an illustrative embodiment of an extended roller 276, or adhesion roller, is presented. The extended roller 276 is formed by a first roller member 122 coupled to a second roller member 278 by the rotatable and releasable magnetic quick-link coupler 150. In one illustrative embodiment, the combined length of the first roller member 122 and second roller member 278 is approximately 24 inches, but of course, other dimensions are possible as desired. The extended roller 276 may be used as an abdominal exerciser 104 when combined with handle tools as shown in FIG. 1. The first and second roller members 122, 278 may have an outside diameter that is greater than four inches and less than 18 inches. Other dimensions are, of course, possible. The extended roller 276 may be used as an exercise tool or adhesion roller. As an adhesion roller participants place between the extended roller 276 the floor (or foundation surface) and their body and manipulate different muscles.

At this point it should be appreciated that the various possible components of the system 100 may be used alone or together and may be combined using the rotatable and releasable magnetic quick-link couplers into many different configurations to allow a participant to exercise or work a muscle or to have a personal trainer or other person assist with muscle manipulation work. The components include the two roller members 122,146; two handle tools 108, 112; and two additional tools: adhesion release ball 116 and trigger point tool 118. It should be understood that other tools might be included as well. The remaining figures further amplify aspects of the combinations and components.

Figure 9:
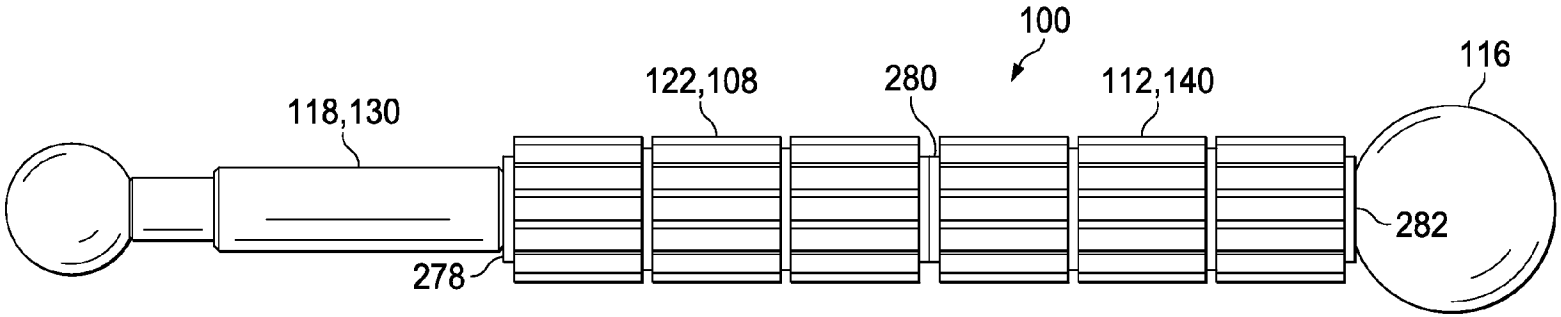
FIG. 9 is a schematic, elevation view of an illustrative embodiment of a portion of a modular system for exercise and muscle manipulation work showing a trigger point tool coupled with a first handle tool, a second handle tool, and an adhesion release ball.

FIG. 9 presents yet another combination of some of the components that may be included as part of the system 100. In this instance the first roller member 122 is the first handle tool 108. The first attachment member 130 is the trigger point tool 118. The second attachment member 140 is the second handle tool 112. In addition, the adhesion release ball 116 is coupled to the second end of the second handle tool 112. This configuration involves three rotatable and releasable magnetic quick-link couplers 278, 280, and 282. This configuration may be particularly useful for applying a force along the longitudinal axis to apply a force using the spherical surface of the trigger point tool 118 or the adhesion release ball 116. An operator, e.g., a trainer, may use this configuration to work a particular muscle for the participant or it may be used by the participant directly to manipulate muscles. The rotation of the handle tools may help resolve friction in such a treatment.

Figure 10:
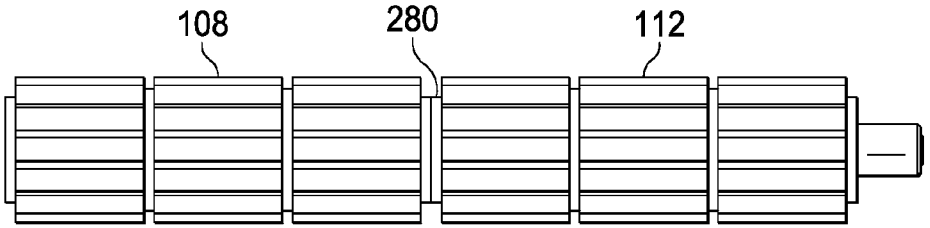
FIG. 10 is a schematic, elevation view of an illustrative embodiment of a portion of a modular system for exercise and muscle manipulation work showing a first handle tool coupled with a second handle tool.

FIG. 10 shows a configuration with the first handle tool 108 and the second handle tool 112 coupled together by the rotatable and releasable magnetic quick-link coupler 280. The handle tools 108, 112 may, of course, take various dimensions. In one embodiment, each handle tool 108, 112 is about 5 inches (12.7 cm) in length with a diameter of about 1.25 inches (3.175 cm). Again, the internal tubular member may have different dimensions, but in one embodiment has 0.75 inch (1.9 cm) diameter and covered with a foam member to avoid slippage and promote comfort. The foam on the handle tools 108, 112 may have various patterns formed thereon such as longitudinal grooves. This configuration may be used as a plantar roller or for applying contact pressure to a small projected area. When used on the foot, one or both of the handle tools 108, 112 may be placed on the floor and then the participant may place their foot on the roller and roll the muscles on the bottom of the foot.

Figure 11:
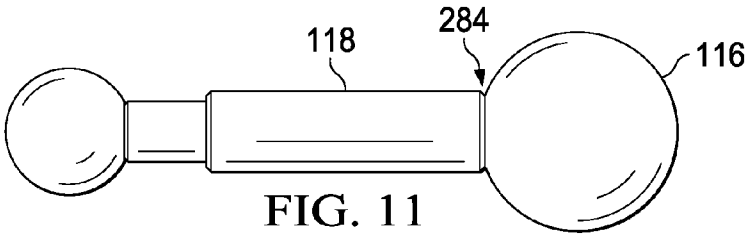
FIG. 11 is a schematic, elevation view of an illustrative embodiment of a portion of a modular system for exercise and muscle manipulation work showing a trigger point tool coupled with an adhesion release ball.

FIG. 11 presents a configuration with the trigger point tool 118 coupled to the adhesion release ball 116 by a rotatable and releasable magnetic quick-link coupler 284. This configuration may be used to manipulate a particular trigger point on a participant's body.

Figure 12:
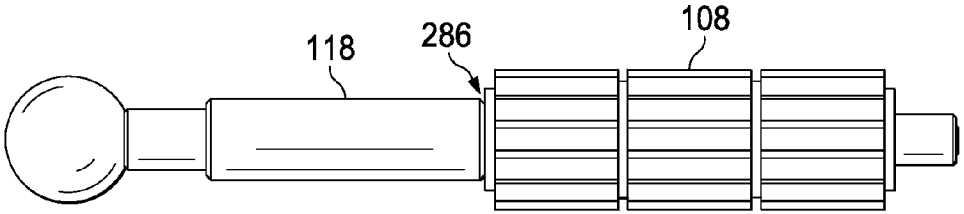
FIG. 12 is a schematic, elevation view of an illustrative embodiment of a portion of a modular system for exercise and muscle manipulation work showing a trigger point tool coupled with a first handle tool.

FIG. 12 shows a configuration with the trigger point tool 118 coupled to the first handle 108 by a rotatable and releasable magnetic quick-link coupler 286. This configuration may be used again to manipulate a particular trigger point on a participant's body and may be particularly useful where additional force or mechanical advantage is desired.

Figure 13:
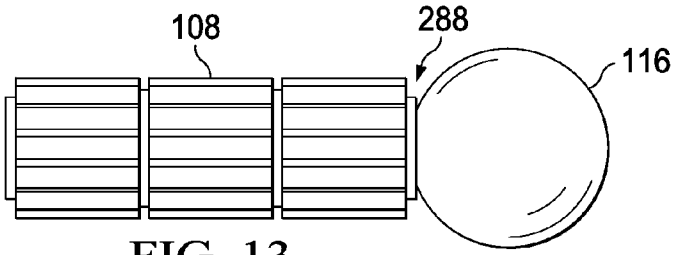
FIG. 13 is a schematic, elevation view of an illustrative embodiment of a portion of a modular system for exercise and muscle manipulation work showing a first handle tool coupled with an adhesion release ball.

FIG. 13 presents a configuration with the first handle tool 108 coupled to the adhesion release ball 116 by a rotatable and releasable magnetic quick-link coupler 288. This configuration may be used to manipulate a particular trigger point on a participant's body.

FIG. 14 presents adhesion release ball 116, or adhesion ball. The adhesion release ball 116 was discussed previously in connection with FIG. 6C. The adhesion release ball 116 may be used to roll individual trigger points against a surface. For example, a portion of an arm might be manipulated using the ball 116 by placing the ball between the arm and a wall and causing relative movement.

Again in this point the versatility of the system 100 should be clear, but additional uses and configurations will be described. In one embodiment, the system 100 is configured with the various components in this order: adhesion roller 116, first handle tool 108, first roller member 122, second roller member 278, second handle tool 112, and trigger point tool 118. The strap 166 is attached to an outside portion of one roller 122 and to the other outside portion of the other roller member 278. This configuration is convenient for carrying the system 100 from one place to another. Other orders of the components could be used as well.

In another embodiment, shown in FIG. 1, the system 100 is assembled with this order: adhesion roller 116, first handle tool 108, first roller member 122, second roller member 278, second handle tool 112, and trigger point tool 118, and is used as an abdominal exerciser. In another similar embodiment, the system 100 is assembled in this order: adhesion roller 116, first handle tool 108, first roller member 122, second handle tool 112, and trigger point tool 118, and again used as an abdominal exerciser.

In one embodiment, shown in FIG. 7, the system 100 is assembled as only a first roller member 122 and second roller member 278. In this configuration, the system 100 is used primarily as an adhesion roller for all different kinds of body parts, e.g., legs, back, IT band (illiotibial band), etc.

In still another illustrative embodiment, the system 100 is assembled with this order: adhesion roller 116, first handle tool 108, second handle tool 112, and trigger point tool 118. This configuration of the system 100 may be used for trigger point muscle manipulation work such as on thigh or other body part. The handle tools 108, 112 may be rolled against the muscle being worked. Alternatively the adhesion roller 116 may be used to work the muscle or the smaller ball of the trigger point tool 118 may be used on the muscle. In another configuration, just the trigger point tool 118 is used alone on muscles. In this scenario, the user may hold the longitudinal body 256 (FIG. 8) of the trigger point tool 118 and apply a force along the longitudinal axis using the ball 254.

In still another embodiment of the system 100, just the adhesion roller or ball 116 is used. To use it, the ball 116 is placed on the floor and the user puts their foot on top of it and rolls. It may also be used for other body parts in a similar way. As another example, the user may put the ball 116 on the floor and sit on it to work the user's gluteus maximus muscle. In another similar embodiment of the system 100, a handle tool 108, 112 is placed on the ground and the user places their foot on top of it and rolls to work muscles on the lower portion of the foot.

These are only some of the possible configurations. It should be understood that various components might be mixed and matched according to the various permutations for different purposes. Moreover other attachments may be used.

For example, in one embodiment medicine balls may have a member of the rotatable and releasable magnetic quick-link couplers installed therein and then mated with a handle tool to make a dumbbell—more than one handle tool may be used.

In one illustrative embodiment, a modular system for exercise and muscle manipulation work includes a first roller member having a cylindrically-shaped body and a first end and a second end. The first roller member has a diameter that is greater than four inches and less than 18 inches. The first roller member comprises a plurality of adhesion roller disc members formed from a polymer-based foam and disposed over a first tubular member, each of the plurality of adhesion roller disc members formed with a plurality of lateral grooves and each having a radius of at least ⅛ of inch. The lateral grooves are substantially parallel to a longitudinal axis of the first roller member. The modular system further includes a first attachment member having a first end and a second end and a first rotatable and releasable magnetic quick-link coupler rotatably and releasably coupling the first end of the first roller member and the second end of the first attachment member. The first rotatable and releasable magnetic quick-link coupler comprises at least one magnet and at least two mating members. The system also includes a second attachment member having a first end and a second end and a second rotatable and releasable magnetic quick-link coupler rotatably and releasably coupling the second end of the first roller member and the first end of the second attachment member, wherein the second rotatable and releasable magnetic quick-link coupler comprises at least one magnet and at least two mating members.

In another illustrative embodiment, a method of manufacturing a modular system for exercise and muscle manipulation work includes providing a first longitudinal tubular member; disposing a plurality of adhesion roller disc members about the longitudinal tubular member to form a first roller member having a first end and a second end; providing a first attachment member formed with a second longitudinal tubular member and having a first end and a second end; and providing a first rotatable and releasable magnetic quick-link coupler having a first member and a second member. The method also includes coupling the first member of the first rotatable and releasable magnetic quick-link coupler to the second end of the first attachment member; coupling the second member of the first rotatable and releasable magnetic quick-link coupler to the first end of the first roller member; providing a second attachment member formed with a third longitudinal tubular member having a first end and a second end; providing a second rotatable and releasable magnetic quick-link coupler having a first member and a second member; coupling the first member of the second rotatable and releasable magnetic quick-link coupler to the second end of the first roller member and first end of the second attachment member; and coupling the second member of the second rotatable and releasable magnetic quick-link coupler to the first end of the second attachment member.

In one illustrative embodiment, a modular system for exercise and muscle manipulation work includes a configuration with at first roller member 122 or a second roller member 146 that have a plurality of roller disc members that are independent in rotation to each other. The disc members may be covered with a mono-cellular foam in the 2 to 10 lb. density.

Although the present invention and its advantages have been disclosed in the context of certain illustrative, non-limiting embodiments, it should be understood that various changes, substitutions, permutations, and alterations can be made without departing from the scope of the invention as defined by the claims. It will be appreciated that any feature that is described in a connection to any one embodiment may also be applicable to any other embodiment.

What is claimed:

1. A modular system for exercise and muscle manipulation work, the system comprising:

a central member having a cylindrically-shaped body and a first end and a second end;

a first attachment member having a first end and a second end;

a second attachment member having a first end and a second end;

a first rotatable and releasable magnetic quick-link coupler associated with the central member and the first attachment member for releasably and rotatably coupling the central member to the first attachment member;

a second rotatable and releasable magnetic quick-link coupler associated with the central member and the second attachment member for releasably and rotatably coupling the central member to the second attachment member; and wherein each of the rotatable and releasable magnetic quick-link couplers comprises:

a protruding member having a first magnetic member, a female receptacle sized and configured to receive at least a portion of the protruding member and having a second magnetic member, wherein the first magnetic member and second magnetic member comprise at least a magnet and a complimentary attractive material.

2. The system of claim 1, wherein the complimentary attractive material comprises one of the group of a second magnet and magnetically-attractive material.

3. The system of claim 1, wherein the first attachment member comprises a member selected from a group consisting of an adhesion release ball, a handle tool, a roller member, and a trigger point tool.

4. The system of claim 3, wherein the second attachment member comprises a member selected from a group consisting of an adhesion release ball, a handle tool, a roller member, and a trigger point tool.

5. The system of claim 1, wherein the cylindrically-shaped body of the first roller member comprises a plurality of roller disc members.

6. The system of claim 1, wherein the central member comprises a first roller member having a diameter greater than four inches and less than 18 inches.

7. The system of claim 1, wherein the central member comprises a first roller member and wherein the cylindrically-shaped body of the first roller member comprises a plurality of adhesion roller disc members, and wherein at least one of the plurality of adhesion rollers is at least ten percent less rigid than an average stiffness for the plurality of adhesion roller members.

8. The system of claim 1, wherein the central member comprises a first roller member and wherein the cylindrically-shaped body of the first roller member comprises a plurality of adhesion roller disc members, wherein a plurality of longitudinal grooves are formed on an exterior of the plurality of adhesion roller members, and wherein the grooves are substantially parallel to a longitudinal axis of the first roller member.

9. The system of claim 1, wherein the central member comprises a first roller member and wherein the cylindrically-shaped body of the first roller member comprises a plurality of adhesion roller disc members, wherein a plurality of longitudinal grooves are formed on an exterior of the plurality of adhesion roller members, wherein the grooves are substantially parallel to a longitudinal axis of the first roller member.

10. The system of claim 1 further comprising:

wherein the first attachment member comprises a second roller member having a cylindrically-shaped body and a first end and a second end;

further comprising a third attachment member having a first end and a second end; and further comprising a third rotatable and releasable magnetic quick-link coupler associated with the third attachment member and the first attachment member for releasably and rotatably coupling the first attachment member and third attachment member.

11. The system of claim 1, wherein the first attachment member comprises a first tool handle;

wherein the second attachment member comprises a second roller member having a first end and a second end; and further comprising:

a second tool handle having a first end a second end, a trigger point tool having a first end and a second end, an adhesion ball having first end and second end, a third rotatable and releasable magnetic quick-link coupler associated with the second end of the adhesion ball and the first end of the first tool handle for releasably and rotatably coupling the adhesion ball to the first tool handle, a fourth rotatable and releasable magnetic quick-link coupler associated with the second end of the second roller member and the first end of the second tool handle for releasably and rotatably coupling the second roller member to the second tool handle, and a fifth rotatable and releasable magnetic quick-link coupler associated with the second end of the second tool handle and first end of the trigger point tool for releasably and rotatably coupling the second tool handle to the trigger point tool.

12. The system of claim 1, wherein the central member comprises a first roller member and further comprising a first strap holder coupled to the first end of the first roller member, a second strap holder coupled to the second end of the second attachment member, and a strap coupled to the first strap holder and the second strap holder.

13. The system of claim 1, wherein the central member comprises a first roller member and wherein;

wherein the first roller member has a diameter greater than four inches;

wherein the first attachment member comprises a first tool handle having a first diameter greater than an inch and less than three inches;

wherein the second attachment member comprises a second roller member having a first end and a second end, and wherein the second roller member has a second diameter greater than four inches; and further comprising:

a second tool handle having a first end a second end, wherein the second tool has a diameter less than five inches;

a trigger point tool having a first end and a second end;

an adhesion ball having first end and second end and having diameter greater than one inch, a third rotatable and releasable magnetic quick-link coupler associated with the second end of the adhesion ball and the first end of the first tool handle for releasably and rotatably coupling the adhesion ball to the first tool handle, a fourth rotatable and releasable magnetic quick-link coupler associated with the second end of the second roller member and the first end of the second tool handle for releasably and rotatably coupling the second roller member to the second tool handle, and a fifth rotatable and releasable magnetic quick-link coupler associated with the second end of the second tool handle and first end of the trigger point tool for releasably and rotatably coupling the second tool handle to the trigger point tool.

14. The system of claim 1, wherein the central member comprises a first roller member and wherein the cylindrically-shaped body of the first roller member comprises a plurality of adhesion roller disc members, and wherein at least one of the plurality of adhesion roller disc members is at least ten percent less rigid than an average stiffness for the plurality of adhesion roller disc members.

15. The system of claim 13, wherein the central member comprises a first roller member and wherein the cylindrically-shaped body of the first roller member comprises a plurality of adhesion roller disc members that are disposed about the a tubular member and free to rotate on the tubular member.

16. The system of claim 15, wherein each of the plurality of adhesion roller disc members comprises monocellular foam having a density between 2 and 10 pounds per cubic foot.

17. A modular system for exercise and muscle manipulation work, the system comprising:

a first roller member having a cylindrically-shaped body and a first end and a second end, the first roller member having a diameter that is greater than four inches and less than 18 inches, the first roller member comprising a plurality of adhesion roller disc members formed from a polymer-based foam and disposed over a first tubular member, each of the plurality of adhesion roller disc members formed with a plurality of longitudinal grooves, and wherein the longitudinal grooves are substantially parallel to a longitudinal axis of the first roller member;

a first attachment member having a first end and a second end;

a first rotatable and releasable magnetic quick-link coupler rotatably and releasably coupling the first end of the first roller member and the second end of the first attachment member, wherein the first rotatable and releasable magnetic quick-link coupler comprises at least one magnet and at least two mating members;

a second attachment member having a first end and a second end; and a second rotatable and releasable magnetic quick-link coupler rotatably and releasably coupling the second end of the first roller member and the first end of the second attachment member, wherein the second rotatable and releasable magnetic quick-link coupler comprises at least one magnet and at least two mating members.

18. The system of claim 17, wherein the first attachment member comprises a member selected from a group consisting of an adhesion release ball, a handle tool, an adhesion roller, and a trigger point tool.

19. The system of claim 18, wherein the second attachment member comprises a member selected from a group consisting of an adhesion release ball, a handle tool, an adhesion roller, and a trigger point tool.

20. A method of manufacturing a modular system for exercise and muscle manipulation work, the method comprising:

providing a first longitudinal tubular member;

disposing a plurality of adhesion roller disc members about the longitudinal tubalar member to form a first roller member having a first end and a second end and having a diameter greater than 5 inches;

providing a first attachment member formed with a second longitudinal tubular member and having a first end and a second end;

providing a first rotatable and releasable magnetic quick-link coupler having a first member and a second member;

coupling the first member of the first rotatable and releasable magnetic quick-link coupler to the second end of the first attachment member;

coupling the second member of the first rotatable and releasable magnetic quick-link coupler to the first end of the first roller member;

providing a second attachment member formed with a third longitudinal tubular member having a first end and a second end;

providing a second rotatable and releasable magnetic quick-link coupler having a first member and a second member;

coupling the first member of the second rotatable and releasable magnetic quick-link coupler to the second end of the first roller member and first end of the second attachment member; and coupling the second member of the second rotatable and releasable magnetic quick-link coupler to the first end of the second attachment member.

21. The method of claim 20, wherein the first member of the first rotatable and releasable magnetic quick-link coupler comprises a male member having a magnet or a magnetically-attractable material on a protrusion end, and wherein the second member of the first rotatable and releasable magnetic quick-link coupler comprises a female receptacle formed on the first end of the first roller member and having a magnet or magnetically-attractable material within the female receptacle, and wherein the first rotatable and releasable magnetic quick-link coupler comprises at least one magnet.

22. The method of claim 20, further comprising using a water jet to form a plurality of longitudinal channels on an exterior of the adhesion roller disc members.

23. The method of claim 20, wherein the plurality of adhesion roller disc members comprise at least one roller disc member that is ten percent less rigid than an average stiffness for the plurality of adhesion roller disc members.

* * * * *